US009227238B2

(12) United States Patent
Ishii

(10) Patent No.: US 9,227,238 B2
(45) Date of Patent: Jan. 5, 2016

(54) HOT-PRESSING APPARATUS

(75) Inventor: Shinji Ishii, Togo-cho (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 19 days.

(21) Appl. No.: 14/126,533

(22) PCT Filed: Jun. 29, 2011

(86) PCT No.: PCT/JP2011/064969

§ 371 (c)(1),
(2), (4) Date: Dec. 16, 2013

(87) PCT Pub. No.: WO2013/001630

PCT Pub. Date: Jan. 3, 2013

(65) Prior Publication Data

US 2014/0123721 A1 May 8, 2014

(51) Int. Cl.

| | |
|---|---|
| ***B21D 37/16*** | (2006.01) |
| ***B21D 22/20*** | (2006.01) |
| ***B21D 22/28*** | (2006.01) |
| ***B21D 22/02*** | (2006.01) |

(52) U.S. Cl.

CPC ..... *B21D 22/20* (2013.01); *B21D 22/022* (2013.01); *B21D 22/208* (2013.01); *B21D 22/286* (2013.01); *B21D 37/16* (2013.01)

(58) Field of Classification Search

CPC .... B21D 37/16; B21D 22/208; B21D 22/022; B21D 22/20; B21D 37/18; B21D 22/286; B21D 22/201; B30B 15/064; B30B 15/34

USPC ..... 72/342.2–342.6, 342.96, 364, 38, 72/342.94, 342, 342.7, 41, 43–45; 148/643, 647, 654, 661

See application file for complete search history.

(56) References Cited

U.S. PATENT DOCUMENTS

| | | | | |
|---|---|---|---|---|
| 2007/0017272 | A1 * | 1/2007 | Kurisu et al. | 72/342.2 |
| 2011/0232354 | A1 | 9/2011 | Hielscher et al. | |

FOREIGN PATENT DOCUMENTS

| | | | |
|---|---|---|---|
| DE | 102010012579 | B3 | 7/2011 |
| GB | 2 109 722 | A | 6/1983 |
| JP | B1 44-158 | | 1/1969 |
| JP | A 58-135749 | | 8/1983 |
| JP | A 61-195745 | | 8/1986 |
| JP | A 8-155558 | | 6/1996 |
| JP | A 2005-7442 | | 1/2005 |
| JP | A 2007-326112 | | 12/2007 |
| JP | A 2008-36709 | | 2/2008 |
| JP | A 2010-36208 | | 2/2010 |

* cited by examiner

*Primary Examiner* — Peter DungBa Vo
*Assistant Examiner* — Joshua D Anderson
(74) *Attorney, Agent, or Firm* — Oliff PLC

(57) ABSTRACT

Disclosed is a hot-pressing apparatus capable of quenching a workpiece at a sufficient cooling rate. A hot-pressing apparatus includes a lower die and an upper die. The hot-pressing apparatus causes the dies to press a workpiece, and at the same time, to keep the forming surfaces thereof in contact with the workpiece to cool the workpiece. Depression parts are formed in parts of the lower die which faces external corners of the upper die, and parts of the upper die which faces external corners of the lower die. The water-feed channel and the lower water-feed device, and the water-feed channel and the upper water-feed device are provided to feed cooling water to spaces between the workpiece and the dies.

9 Claims, 6 Drawing Sheets

HOT-PRESSING APPARATUS

TECHNICAL FIELD

The present invention relates to a hot-pressing apparatus which presses and cools a heated workpiece at the same time.

BACKGROUND ART

Conventionally, a hot-pressing apparatus is widely known which causes upper and lower dies (a pair of dies) to press a workpiece, such as a steel plate, heated to above a temperature at which an austenite structure appears, and at the same time, to come in contact with the workpiece to quench the workpiece.

A technique on the hot-pressing apparatus is publicly known which enables the dies to suitably cool the workpiece during the quenching by providing water channels through which cooling water flows to the inside of the dies to cool the dies (for example, see Patent Literature 1).

However, gaps are formed, when the workpiece is quenched, between the workpiece and the dies by variation in the thickness of the workpiece caused by the press working, a precision error of the forming surface of the dies caused when the dies are manufactured, flexure of the dies during the press working, and the like. Consequently, contact areas between the surface of the workpiece and the forming surfaces of the dies decrease when the workpiece is quenched, which causes a problem that some parts in the workpiece are cooled at an insufficient cooling rate, and hardness of the workpiece is partly smaller than a predetermined value.

CITATION LIST

Patent Literature

Patent Literature 1: JP 2005-7442 A

SUMMARY OF INVENTION

Problem to be Solved by the Invention

The objective of the present invention is to provide a hot-pressing apparatus capable of quenching a workpiece at a sufficient cooling rate.

Means for Solving the Problem

A first aspect of the invention is a hot-pressing apparatus including a lower die having a lower forming surface, and an upper die having an upper forming surface facing the lower forming surface, which causes the lower die and the upper die to press a heated workpiece arranged therebetween, and at the same time, to keep the forming surfaces thereof in contact with a surface of the workpiece to cool the workpiece. The hot-pressing apparatus includes a depression part recessed inward from the forming surface of the lower die and/or the upper die, which is formed in a part of the lower die which faces a working part of the upper die for bending the workpiece, and/or a part of the upper die which faces a working part of the lower die for bending the workpiece, and a cooling water-feed means which feeds cooling water for cooling the workpiece to a space between the workpiece, and the lower die and/or the upper die where the depression part is formed.

Preferably, the lower die and/or the upper die where the depression part is formed has a vent passage through which steam generated when the cooling water comes in contact with the workpiece flows, and the vent passage is formed inside the lower die and/or the upper die from a surface thereof other than the forming surface to the space between the workpiece, and the lower die and/or the upper die.

More preferably, the vent passage is formed from a surface of the lower die and/or the upper die other than the forming surface to the depression part.

Even more preferably, the hot-pressing apparatus includes a suction device which sucks the steam flowing through the vent passage, the suction device being connected to the vent passage.

Advantageously, the hot-pressing apparatus includes a refrigerant-feed means which feeds a refrigerant to the depression part, the refrigerant-feed means being arranged in the depression part.

Effects of the Invention

The present invention makes it possible to quench a workpiece at a sufficient cooling rate, and to prevent hardness of some parts in the workpiece from being smaller than a predetermined value.

DESCRIPTION OF EMBODIMENTS

First Embodiment

Figure 1:
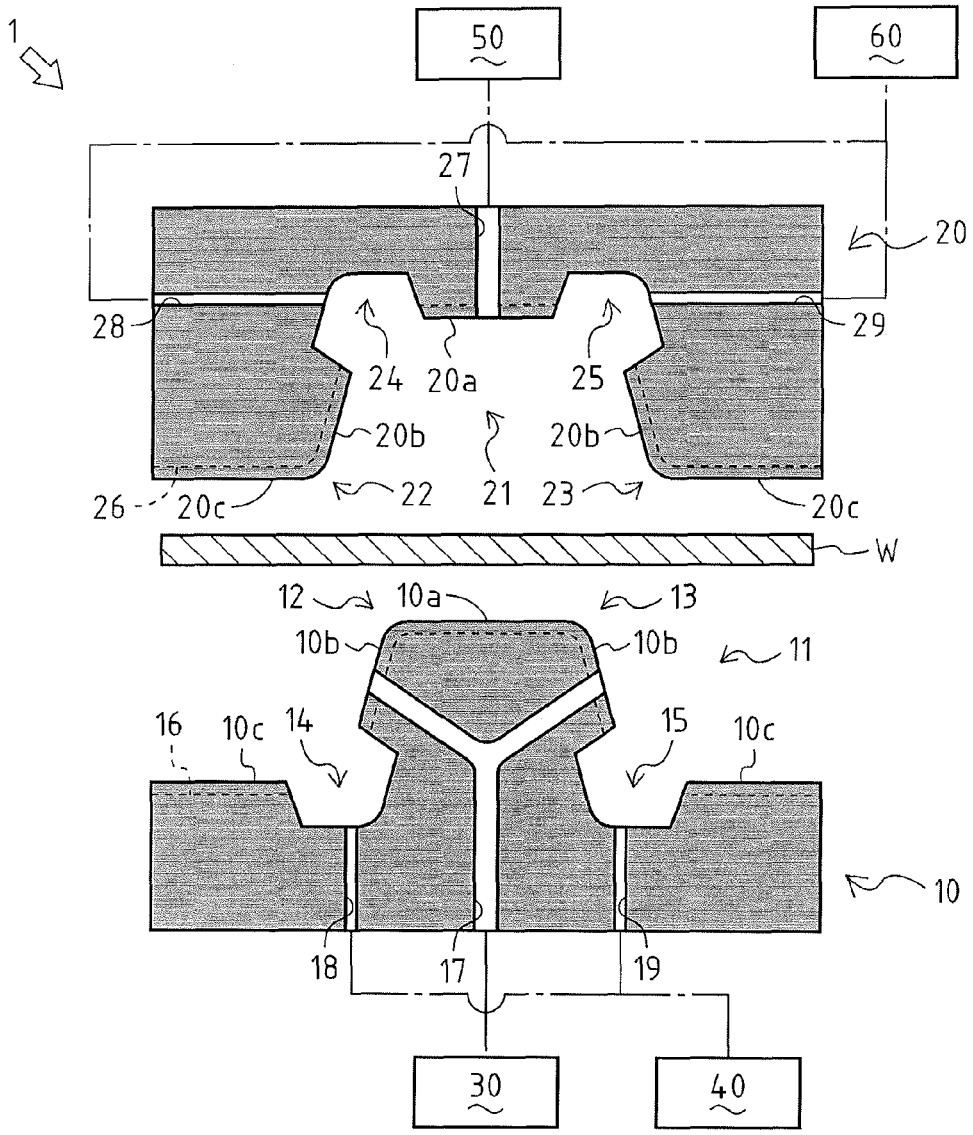
FIG. 1 illustrates a hot-pressing apparatus according to a first embodiment of the present invention.
Figure 2:
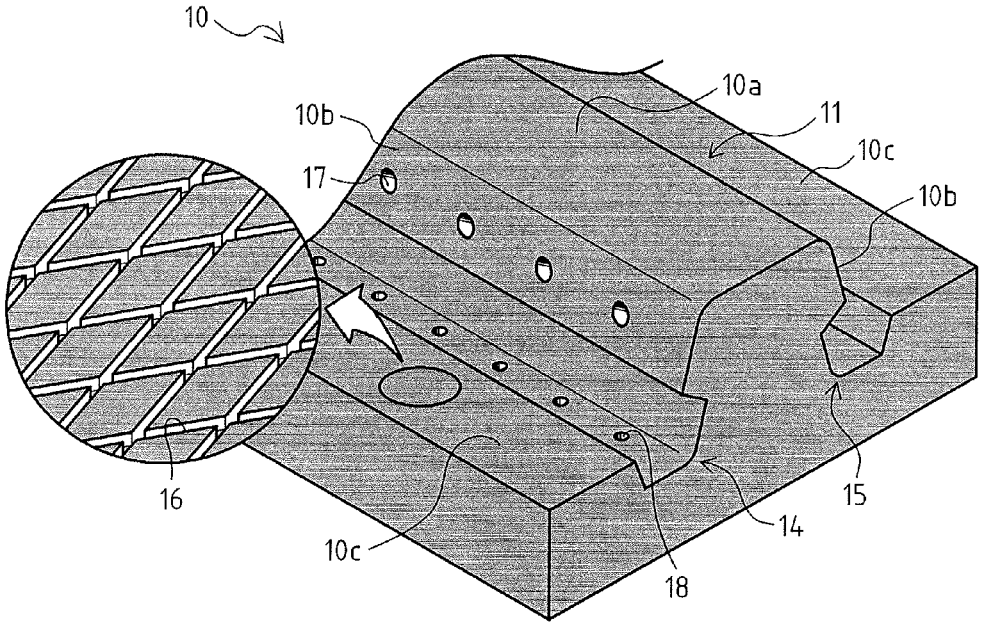
FIG. 2 is a perspective view showing a lower die of the hot-pressing apparatus according to the first embodiment of the present invention.

With reference to FIGS. 1 and 2, described below is a hot-pressing apparatus 1 as a first embodiment of a hot-pressing apparatus according to the present invention.

The hot-pressing apparatus 1 performs hot-press forming of a workpiece W.

The workpiece W is a steel plate to be worked by the hot-pressing apparatus 1, and is heated to above a temperature at which an austenite structure appears by ohmic heating and the like.

For convenience, a top-bottom direction in FIG. 1 is defined as a top-bottom direction of the hot-pressing apparatus 1, and a right-left direction in FIG. 1 is defined as a right-left direction of the hot-pressing apparatus 1. In addition, this side in FIG. 1 is defined as a front side of the hot-pressing apparatus 1, and the far side in FIG. 1 is defined as a rear side of the hot-pressing apparatus 1, thereby a front-rear direction of the hot-pressing apparatus 1 being defined.

As shown in FIG. 1, the hot-pressing apparatus 1 includes a lower die 10 and an upper die 20 whose forming surfaces face each other, a lower water-feed device 30 and a lower suction device 40 connected to the lower die 10, and an upper water-feed device 50 and an upper suction device 60 connected to the upper die 20.

The lower die 10 and the upper die 20 are arranged so that the forming surfaces thereof face each other. The upper die 20 is brought close to the lower die 10, and is moved to the bottom dead center by a hydraulic cylinder and the like. Thereby, the lower die 10 and the upper die 20 press the heated plate-like workpiece W arranged therebetween to form the workpiece W into what is called a hat shape. At the same time, the lower die 10 and the upper die 20 keep the forming surfaces thereof in contact with the surface of the workpiece W to cool the workpiece W. Consequently, the workpiece W as a product is produced.

First, the general forms of the lower die 10 and the upper die 20 are described.

The lower die 10 corresponds to the upper die 20.

The lower die 10 has a protrusion 11 which protrudes upward from the forming surface (the upper surface) thereof.

The protrusion 11 protrudes upward from the forming surface of the lower die 10. The protrusion 11 is continuously formed in the front-rear direction in the intermediate part (the substantially middle part), in the right-left direction, of the forming surface of the lower die 10.

The lower die 10 has a top surface 10*a* extending in the right-left direction at the protruding end (uppermost part) of the protrusion 11, two lateral surfaces 10*b* which are right and left surfaces of the protrusion 11, and two base surfaces 10*c* which are forming surfaces of the parts in which the protrusion 11 is not formed. These surfaces act as what is called a hat-shaped forming surface of the lower die 10.

The part of the lower die 10 at which the top surface 10*a* and the left lateral surface 10*b* meet is formed as a rounded external corner 12. The part of the lower die 10 at which the top surface 10*a* and the right lateral surface 10*b* meet is formed as a rounded external corner 13.

Figure 3:
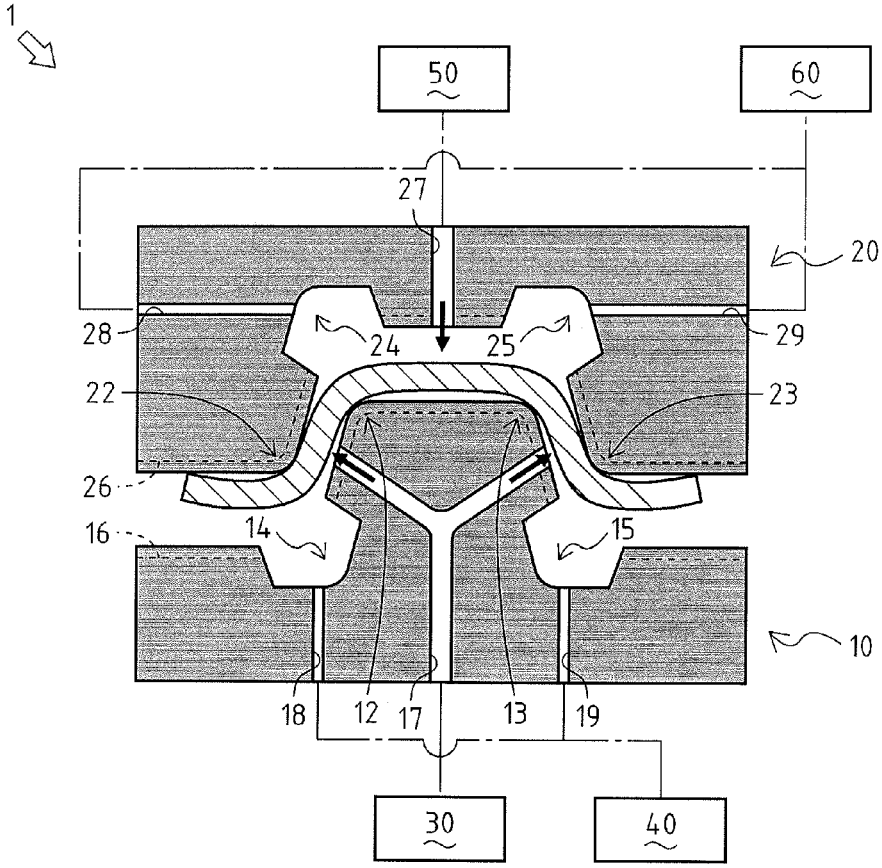
FIG. 3 illustrates the hot-pressing apparatus in which an upper die is moving to the bottom dead center.

The external corners 12 and 13 act as working parts when the lower die 10 and the upper die 20 press the workpiece W (see FIG. 3).

Note that the "working parts" of the dies (the lower die 10 and the upper die 20) are corners in the forming surfaces of the dies, and are parts for bending the workpiece W when the dies press the workpiece W.

The upper die 20 corresponds to the lower die 10.

The upper die 20 has a recess 21 recessed upward from the forming surface (the lower surface) of the upper die 20 in conformity with the shape of the protrusion 11.

The recess 21 is formed so that the forming surface of the upper die 20 is recessed upward. The recess 21 is continuously formed in the front-rear direction in the intermediate part (the substantially middle part), in the right-left direction, of the forming surface of the upper die 20.

The upper die 20 has a bottom surface 20*a* extending in the right-left direction at the innermost part (uppermost part) of the recess 21, two lateral surfaces 20*b* which are right and left surfaces of the recess 21, and two base surfaces 20*c* which are forming surfaces of the parts in which the recess 21 is not formed. These surfaces act as what is called a hat-shaped forming surface of the upper die 20.

The part of the upper die 20 at which the left lateral surface 20*b* and the left base surface 20*c* meet is formed as a rounded external corner 22. The part of the upper die 20 at which the right lateral surface 20*b* and the right base surface 20*c* meet is formed as a rounded external corner 23.

The external corners 22 and 23 act as the working parts when the lower die 10 and the upper die 20 press the workpiece W (see FIG. 3).

Next, structures of the lower die 10 and the upper die 20 are described in detail.

The lower die 10 has depression parts 14 and 15 recessed inward from the forming surface of the lower die 10.

The depression part 14 is continuously formed in the whole area, in the front-rear direction, of the forming surface of the lower die 10 by inward recessing the part of the forming surface at which the left lateral surface 10*b* and the left base surface 10*c* meet. In other words, the depression part 14 is provided to the part of the lower die 10 facing the external corner 22 of the upper die 20.

The depression part 15 is continuously formed in the whole area, in the front-rear direction, of the forming surface of the lower die 10 by inward recessing the part of the forming surface at which the right lateral surface 10*b* and the right base surface 10*c* meet. In other words, the depression part 15 is provided to the part of the lower die 10 facing the external corner 23 of the upper die 20.

A groove 16 is formed on the forming surface of the lower die 10.

As shown in FIGS. 1 and 2, the groove 16 is a minute groove with a predetermined depth (dimension in the top-bottom direction) formed on the whole areas of the top surface 10*a*, the lateral surfaces 10*b* and the base surfaces 10*c*. The groove 16 consists of a plurality of grooves which are arranged parallel to each other at predetermined intervals, and which extend in a first direction, and a plurality of grooves which are arranged parallel to each other at predetermined intervals, and which extend in a second direction so as to intersect with the plurality of grooves extending in the first direction. Thus, the groove 16 is formed in a mesh.

As shown in FIG. 1, the lower die 10 has a water-feed channel 17, and vent passages 18 and 19, the water-feed channel 17, and the vent passages 18 and 19 being formed inside the lower die 10.

The water-feed channel 17 is a channel through which cooling water for cooling the heated workpiece W flows. The water-feed channel 17 is bored through the lower die 10 from the bottom surface of the lower die 10 to the lateral surfaces 10*b*. The water-feed channel 17 branches into a plurality of parts in the lower die 10 so that a plurality of openings are formed on the lateral surfaces 10*b* in the front-rear direction (see FIG. 2). Note that each of the openings of the water-feed channel 17 formed on the lateral surfaces 10*b* has such an inner diameter that the openings have no negative influence on the press working of the workpiece W (that the press working of the workpiece W is performed similarly to a conventional press working thereof).

The vent passages 18 and 19 are passages for discharging steam which results from vaporization of the cooling water during the quenching of the workpiece W into the outside of the lower die 10. The vent passages 18 and 19 are formed from a surface of the lower die 10 other than the forming surface thereof to a space between the lower die 10 and the workpiece W. Specifically, the vent passages 18 and 19 are bored through the lower die 10 in the top-bottom direction from the bottom surface of the lower die 10 to the depression parts 14 and 15, respectively. The vent passage 18 branches into a plurality of parts in the lower die 10 so that a plurality of openings are formed on the depression part 14 in the front-rear direction, and the vent passage 19 branches into a plurality of parts in the lower die 10 so that a plurality of openings are formed on the depression part 15 in the front-rear direction (see FIG. 2).

The upper die 20 has depression parts 24 and 25 recessed inward from the forming surface of the upper die 20.

The depression part 24 is continuously formed in the whole area, in the front-rear direction, of the forming surface of the upper die 20 by inward recessing the part of the forming surface at which the bottom surface 20*a* and the left lateral surface 20*b* meet. In other words, the depression part 24 is provided to the part of the upper die 20 facing the external corner 12 of the lower die 10.

The depression part 25 is continuously formed in the whole area, in the front-rear direction, of the forming surface of the upper die 20 by inward recessing the part of the forming surface at which the bottom surface 20*a* and the right lateral surface 20*b* meet. In other words, the depression part 25 is provided to the part of the upper die 20 facing the external corner 13 of the lower die 10.

A groove 26 is formed on the forming surface of the upper die 20.

The groove 26 is substantially similar in configuration to the groove 16 of the lower die 10. The groove 26 has a predetermined depth (dimension in the top-bottom direction), and is formed in a mesh on the whole areas of the bottom surface 20*a*, the lateral surfaces 20*b* and the base surfaces 20*c*.

The upper die 20 has a water-feed channel 27, and vent passages 28 and 29, the water-feed channel 27, and the vent passages 28 and 29 being formed inside the upper die 20.

The water-feed channel 27 is a channel through which the cooling water for cooling the heated workpiece W flows. The water-feed channel 27 is bored through the upper die 20 in the top-bottom direction from the top surface of the upper die 20 to the bottom surface 20*a*. Although not shown, the water-feed channel 27 branches into a plurality of parts in the upper die 20 so that a plurality of openings are formed on the bottom surface 20*a* in the front-rear direction. Note that each of the openings of the water-feed channel 27 formed on the bottom surface 20*a* has such an inner diameter that the openings have no negative influence on the press working of the workpiece W (that the press working of the workpiece W is performed similarly to a conventional press working thereof).

The vent passages 28 and 29 are passages for discharging steam which results from vaporization of the cooling water during the quenching of the workpiece W into the outside of the upper die 20. The vent passages 28 and 29 are formed from a surface of the upper die 20 other than the forming surface thereof to a space between the upper die 20 and the workpiece W.

The vent passage 28 is bored through the upper die 20 in the right-left direction from the left surface of the upper die 20 to the depression parts 24.

The vent passage 29 is bored through the upper die 20 in the right-left direction from the right surface of the upper die 20 to the depression parts 25.

Although not shown, the vent passage 28 branches into a plurality of parts in the upper die 20 so that a plurality of openings are formed on the depression part 24 in the front-rear direction, and the vent passage 29 branches into a plurality of parts in the upper die 20 so that a plurality of openings are formed on the depression part 25 in the front-rear direction.

Described below in detail are the lower water-feed device 30 and the lower suction device 40 connected to the lower die 10, and the upper water-feed device 50 and the upper suction device 60 connected to the upper die 20.

The lower water-feed device 30 is a device, such as a pump, for feeding the cooling water to the space between the lower die 10 and the workpiece W. The lower water-feed device 30 pumps the cooling water to the space between the lower die 10 and the workpiece W at a predetermined pressure (e.g. 10 atm) through the water-feed channel 17. Specifically, the lower water-feed device 30 cause the cooling water stored in a predetermined case to flow into the water-feed channel 17 formed in the lower die 10 from the opening on the bottom surface of the lower die 10, and to flow out from the openings on the lateral surfaces 10*b*.

Thus, the lower water-feed device 30 and the water-feed channel 17 act as a cooling water-feed means which feeds the cooling water to the space between the lower die 10 and the workpiece W.

The lower suction device 40 is device, such as a pump, for sucking steam which results from vaporization of the cooling water when the workpiece W is quenched. The lower suction device 40 is connected to the vent passages 18 and 19 opened on the bottom surface of the lower die 10. The lower suction device 40 sucks, through the vent passages 18 and 19, steam generated when the cooling water comes in contact with the lower surface of the high-temperature workpiece W so as to discharge the steam into the outside of the lower die 10.

The upper water-feed device 50 is a device, such as a pump, for feeding the cooling water to the space between the upper die 20 and the workpiece W. The upper water-feed device 50 pumps the cooling water to the space between the upper die 20 and the workpiece W at a predetermined pressure (e.g. 10 atm) through the water-feed channel 27. Specifically, the upper water-feed device 50 cause the cooling water stored in a predetermined case to flow into the water-feed channel 27 formed in the upper die 20 from the opening on the top surface of the upper die 20, and to flow out from the openings on the bottom surface 20*a*.

Thus, the upper water-feed device 50 and the water-feed channel 27 act as a cooling water-feed means which feeds the cooling water to the space between the upper die 20 and the workpiece W.

The upper suction device 60 is device, such as a pump, for sucking steam which results from vaporization of the cooling water when the workpiece W is quenched. The upper suction device 60 is connected to the vent passage 28 opened on the left surface of the upper die 20, and the vent passage 29 opened on the right surface of the upper die 20. The upper suction device 60 sucks, through the vent passages 28 and 29, steam generated when the cooling water comes in contact with the upper surface of the high-temperature workpiece W so as to discharge the steam into the outside of the upper die 20.

Figure 4:
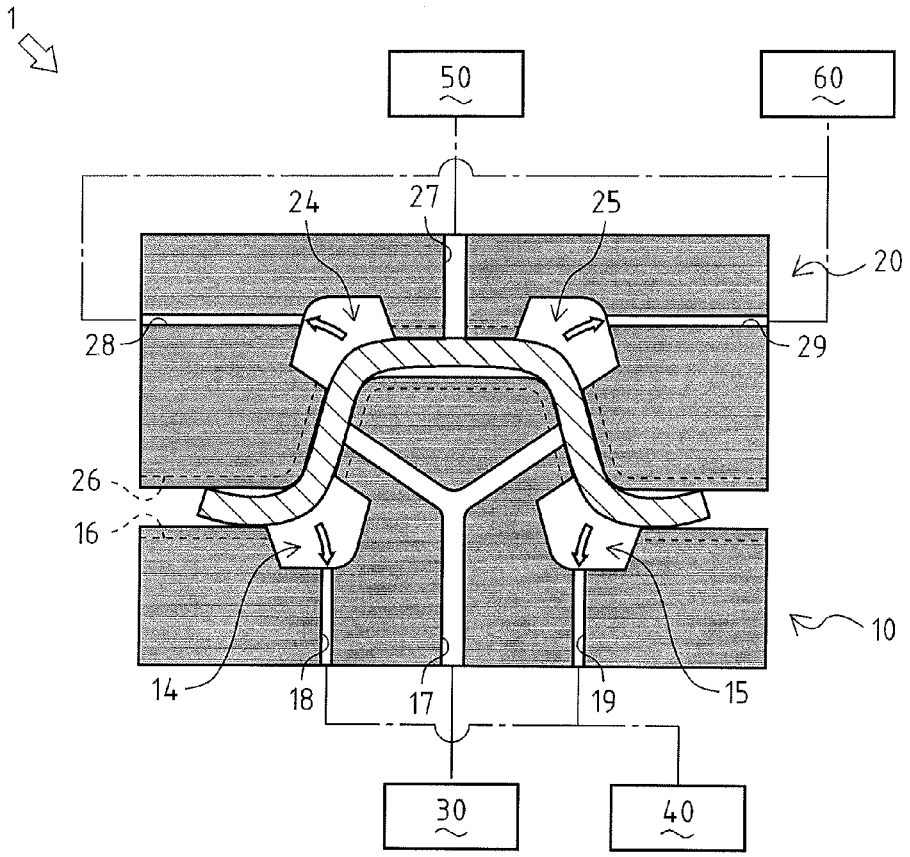
FIG. 4 illustrates the hot-pressing apparatus in which the upper die arrives at the bottom dead center.

With reference to FIGS. 3 and 4, described below in detail is how the hot-pressing apparatus 1 operates when performing the hot-press forming of the workpiece W.

As shown in FIG. 3, during the press working of the workpiece W, when the upper die 20 moves into proximity with the lower die 10 and arrives at the vicinity of the bottom dead center, the lower water-feed device 30 feeds a predetermined amount of the cooling water to the space between the lower die 10 and the workpiece W through the water-feed channel 17, and the upper water-feed device 50 feeds a predetermined amount of the cooling water to the space between the upper die 20 and the workpiece W through the water-feed channel 27.

Note that the black-painted arrows in FIG. 3 show directions in which the cooling water flows.

As shown in FIG. 4, when the upper die 20 arrives at the bottom dead center, the press working of the workpiece W finishes, and thereby the workpiece W is formed into what is called a hat shape. Then, the lower die 10 and the upper die 20 keep the forming surfaces thereof in contact with the lower and upper surfaces of the workpiece W for a predetermined time, and thereby cool the high-temperature workpiece W.

Moreover, the cooling water fed to the space between the lower die 10 and the workpiece W spreads over the forming surface of the lower die 10 through the groove 16, and the cooling water fed to the space between the upper die 20 and the workpiece W spreads over the forming surface of the upper die 20 through the groove 26. Consequently, the forming surfaces of the lower die 10 and the upper die 20 come in contact with the surface of the workpiece W, and additionally the cooling water comes in contact with the whole surface of the workpiece W, thus enabling to suitably cool the workpiece W.

As mentioned above, the groove 16 and the groove 26 are formed on the forming surface of the lower die 10 and the forming surface of the upper die 20, respectively. This makes it possible to cause the cooling water to suitably spread over the forming surfaces of the lower die 10 and the upper die 20 through the groove 16 and the groove 26.

In the present embodiment, each of the groove 16 and the groove 26 is formed in a mesh, but the forms of the groove 16 and the groove 26 are not limited as long as the cooling water suitably spreads over the forming surfaces of the lower die 10 and the upper die 20. For example, a plurality of grooves extending in the right-left direction may be formed at predetermined intervals in the front-rear direction.

During the quenching of the workpiece W as mentioned above, when the cooling water comes in contact with the surface of the high-temperature workpiece W, steam is generated from vaporization of the cooling water.

When the cooling water vaporizes, the volume thereof drastically increases. Therefore, steam generated between the forming surface of the lower die 10 and the lower surface of the workpiece W, and steam generated between the forming surface of the upper die 20 and the upper surface of the workpiece W flow into the depression parts 14 and 15 formed on the forming surface of the lower die 10, and the depression parts 24 and 25 formed on the forming surface of the upper die 20, respectively.

The steam which has flowed into the depression parts 14 and 15 is discharged into the outside of the lower die 10 through the vent passages 18 and 19 by the lower suction device 40, and the steam which has flowed into the depression parts 24 and 25 is discharged into the outside of the upper die 20 through the vent passages 28 and 29 by the upper suction device 60 (see the white-painted arrows in FIG. 4).

Note that an amount of the cooling water fed to the space between the lower die 10 and the workpiece W, and the space between the upper die 20 and the workpiece W is determined so that the cooling water completely vaporizes. A suitable amount of the cooling water can be determined because a quantity of heat which the cooling water should absorb from the high-temperature workpiece W can previously be calculated through a simulation and the like.

In the case where some of the cooling water remain as a liquid without the cooling water vaporizing completely, the remaining cooling water is sucked and removed by the lower suction device 40 and the upper suction device 60.

Since the depression parts 14 and 15, and the depression parts 24 and 25 are formed on the forming surface of the lower die 10 and the forming surface of the upper die 20 respectively, the depression parts 14 and 15, and the depression parts 24 and 25 act as spaces into which the steam generated between the lower die 10 and the workpiece W, and the steam generated between the upper die 20 and the workpiece W flow.

Thereby, the steam with high temperature flows into the depression parts 14 and 15, and the depression parts 24 and 25 without staying in the spaces between the surface of the workpiece W and the forming surfaces of the lower die 10 and the upper die 20.

This makes it possible to effectively use heat of vaporization of the cooling water, and to quench the workpiece W at a sufficient cooling rate.

In particular, in the present invention, the liquid cooling water is used for quenching the workpiece W. Therefore, even in the case where gaps are formed between the lower die 10 and the workpiece W, and between the upper die 20 and the workpiece W, the gaps are filled with the cooling water. This makes it possible to prevent hardness of some parts in the workpiece from being smaller than a predetermined value.

As mentioned previously, the depression parts 14 and 15, and the depression parts 24 and 25 are formed by recessing the forming surfaces, to press the workpiece W, of the lower die 10 and the upper die 20. In other words, no forming surfaces exist on parts of the lower die 10 where the depression parts 14 and 15 are formed, and parts of the upper die 20 where the depression parts 24 and 25 are formed.

However, it is publicly known that press working is suitably performed even if the parts of the forming surface of one die which face the working parts of the other die do not exist. In the present embodiment, the depression parts 14 and 15 are provided to the parts of the lower die 10 which face the external corners 22 and 23 of the upper die 20, and the depression parts 24 and 25 are provided to the parts of the upper die 20 which face the external corners 12 and 13 of the lower die 10, which has no influence on the press working of the workpiece W.

Thus, the depression parts 14 and 15, and the depression parts 24 and 25 are provided to parts which have no influence on the press working of the workpiece W, and are used as the spaces into which the steam flows. This makes it possible to effectively use heat of vaporization of the cooling water.

Moreover, pressures in the depression parts 14 and 15, and the depression parts 24 and 25 are increased by the steam generated when the workpiece W is pressed (see FIG. 3). This makes it possible to evenly apply a pressure to parts of the workpiece W corresponding to the depression parts 14 and 15, and the depression parts 24 and 25 when the workpiece W is pressed.

Inside the lower die 10, the vent passages 18 and 19 are formed from the surface of the lower die 10 other than the forming surface thereof to the space between the lower die 10 and the workpiece W, and inside the upper die 20, the vent passages 28 and 29 are formed from the surface of the upper die 20 other than the forming surface thereof to the space between the upper die 20 and the workpiece W.

Thereby, the steam generated between the lower die 10 and the workpiece W, and steam generated between the upper die 20 and the workpiece W flow outside the lower die 10 and the upper die 20 through the vent passages 18 and 19, and the vent passages 28 and 29. This makes it possible to suitably cool the workpiece W using heat of vaporization of the cooling water.

In particular, the vent passages 18 and 19 are formed so that the depression parts 14 and 15 communicate with the outside of the lower die 10, the vent passages 28 and 29 are formed so that the depression parts 24 and 25 communicate with the outside of the upper die 20. This makes it possible to cause the steam which has flowed into the depression parts 14 and 15, and the depression parts 24 and 25 to effectively flow outside the lower die 10 and the upper die 20. Therefore, it is possible to more suitably cool the workpiece W using heat of vaporization of the cooling water.

The lower suction device 40 and the upper suction device 60 are connected to the vent passages 18 and 19, and the vent passages 28 and 29, respectively.

This makes it possible to cause the steam generated between the lower die 10 and the workpiece W, and steam generated between the upper die 20 and the workpiece W to flow outside the lower die 10 and the upper die 20 through the vent passages 18 and 19, and the vent passages 28 and 29.

Therefore, it is possible to more suitably cool the workpiece W using heat of vaporization of the cooling water.

In the present embodiment, the lower die 10 is provided with the vent passages 18 and 19, and the lower suction device 40, and the upper die 20 is provided with the vent passages 28 and 29, and the upper suction device 60. However, a configuration of the hot-pressing apparatus 1 is not limited thereto.

For example, the lower die 10 may be provided with no lower suction device 40 and only the vent passages 18 and 19, and the upper die 20 may be provided with no upper suction device 60 and only the vent passages 28 and 29.

Moreover, the lower die 10 and the upper die 20 may not be provided with the vent passages 18, 19, 28 and 29, and the suction devices 40 and 60.

In the present embodiment, the vent passages 18 and 19, and the vent passages 28 and 29 are formed to open on the depression parts 14 and 15, and the depression parts 24 and 25, respectively. However, a configuration of the hot-pressing apparatus 1 is not limited thereto.

A flow of the steam generated when the workpiece W is quenched differs depending on shapes and the like of the dies (the lower die 10 and the upper die 20). Therefore, vent passages are formed so as to discharge the steam into the outside of the dies from destinations between the surface of the workpiece W and the forming surfaces of the dies where the steam flows. In other words, the vent passages are formed at positions where the steam is difficult to stay in the spaces between the surface of the workpiece W and the forming surfaces of the dies.

For example, since the steam is easy to flow upward, the vent passages may be formed to open on the top surface 10*a* situated at the uppermost part of the lower die 10 so that the lower suction device 40 sucks the steam through the vent passages.

Moreover, the water-feed channel 17 and the water-feed channel 27 may be used as vent passages for discharging the steam, and the vent passages 18 and 19, and the vent passages 28 and 29 may be used as water-feed channel for feeding the cooling water.

Note that the flow of the steam can previously be analyzed by a simulation and the like.

In the present embodiment, when the upper die 20 arrives at the vicinity of the bottom dead center, namely, when the workpiece W is being pressed, the cooling water is fed to the spaces between the workpiece W and the dies. However, the cooling water may be fed to the spaces between the workpiece W and the dies after the upper die 20 arrives at the bottom dead center.

In the present embodiment, the water-feed channel 17 is formed so that the cooling water flows out from the openings on the lateral surfaces 10*b*, and the water-feed channel 27 is formed so that the cooling water flows out from the openings on the bottom surface 20*a*. However, positions where the cooling water flowing into the spaces between the workpiece W and the dies is fed are not limited.

Second Embodiment

Figure 5:
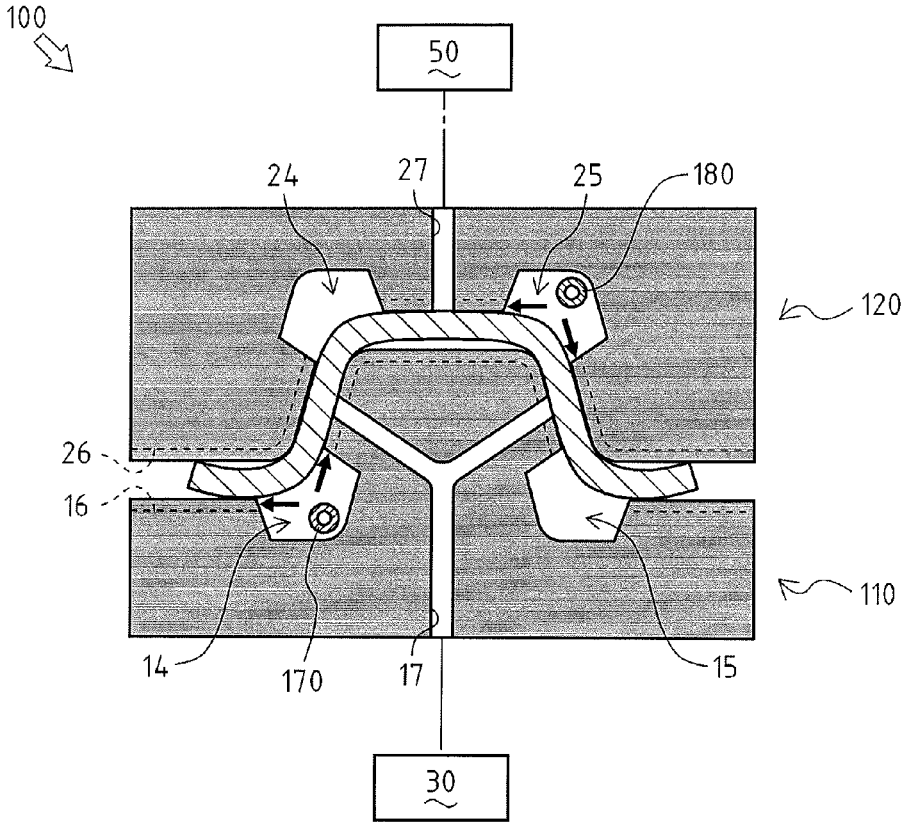
FIG. 5 illustrates a hot-pressing apparatus according to a second embodiment of the present invention.
Figure 6:
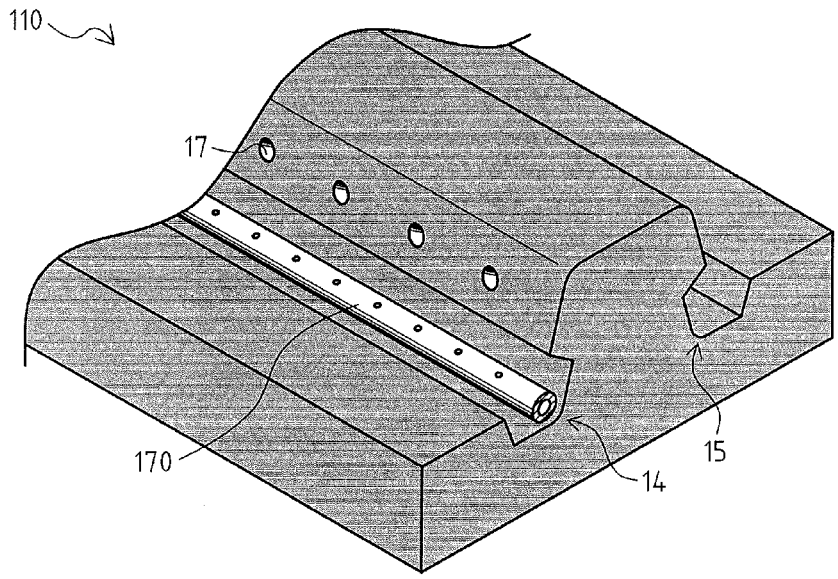
FIG. 6 is a perspective view showing a lower die of the hot-pressing apparatus according to the second embodiment of the present invention.

With reference to FIGS. 5 and 6, described below is a hot-pressing apparatus 100 as a second embodiment of a hot-pressing apparatus according to the present invention.

The hot-pressing apparatus 100 performs the hot-press forming of the workpiece W.

For convenience, a top-bottom direction in FIG. 5 is defined as a top-bottom direction of the hot-pressing apparatus 100, and a right-left direction in FIG. 5 is defined as a right-left direction of the hot-pressing apparatus 100. In addition, this side in FIG. 5 is defined as a front side of the hot-pressing apparatus 100, and the far side in FIG. 5 is defined as a rear side of the hot-pressing apparatus 100, thereby a front-rear direction of the hot-pressing apparatus 100 being defined.

Hereinafter, each of the parts common to the hot-pressing apparatus 1 and the hot-pressing apparatus 100 is indicated by same reference sign, and description thereof is omitted.

As shown in FIG. 5, the hot-pressing apparatus 100 includes a lower die 110 and an upper die 120 whose forming surfaces face each other, the lower water-feed device 30 connected to the lower die 110, and the upper water-feed device 50 connected to the upper die 120.

The lower die 110 is substantially similar in configuration to the lower die 10 of the hot-pressing apparatus 1. The lower die 110 differs from the lower die 10 in that the vent passages 18 and 19 are not provided, and that a lower refrigerant-spout pipe 170 is provided.

As shown in FIG. 6, the lower refrigerant-spout pipe 170 is a pipe through which a refrigerant flows, and extends in the front-rear direction. The lower refrigerant-spout pipe 170 is provided to the depression part 14, and is arranged not to come in contact with the workpiece W during the press working of the workpiece W. On the outer circumferential surface of the lower refrigerant-spout pipe 170, a plurality of minute through-holes connecting the inside and the outside of the lower refrigerant-spout pipe 170 are formed at predetermined intervals in the front-rear direction. A predetermined device (not shown) causes the refrigerant supplied to the inside of the lower refrigerant-spout pipe 170 to spout in the form of a mist from the plurality of through-holes.

Thus, the lower refrigerant-spout pipe 170 acts as a refrigerant-feed means which feeds the refrigerant to the depression part 14.

In the present embodiment, liquid nitrogen is adopted as the refrigerant.

As shown in FIG. 5, the upper die 120 is substantially similar in configuration to the upper die 20 of the hot-pressing apparatus 1. The upper die 120 differs from the upper die 20 in that the vent passages 28 and 29 are not provided, and that an upper refrigerant-spout pipe 180 is provided.

The upper refrigerant-spout pipe 180 is a pipe through which the refrigerant flows, and extends in the front-rear direction. The upper refrigerant-spout pipe 180 is provided to the depression part 25, and is arranged not to come in contact with the workpiece W during the press working of the workpiece W. Although not shown, on the outer circumferential surface of the upper refrigerant-spout pipe 180, a plurality of minute through-holes connecting the inside and the outside of the upper refrigerant-spout pipe 180 are formed at predetermined intervals in the front-rear direction. A predetermined device (not shown) causes the refrigerant supplied to the inside of the upper refrigerant-spout pipe 180 to spout in the form of a mist from the plurality of through-holes.

Thus, the upper refrigerant-spout pipe 180 acts as a refrigerant-feed means which feeds the refrigerant to the depression part 25.

After the upper die 120 arrives at the vicinity of the bottom dead center and the press working of the workpiece W finishes, the lower water-feed device 30 feeds a predetermined amount of the cooling water to the space between the lower die 110 and the workpiece W through the water-feed channel 17, and the upper water-feed device 50 feeds a predetermined amount of the cooling water to the space between the upper die 120 and the workpiece W through the water-feed channel 27.

Then, the lower refrigerant-spout pipe 170 spouts the refrigerant in the form of a mist to the depression part 14, and the upper refrigerant-spout pipe 180 spouts the refrigerant in the form of a mist to the depression part 25.

Since liquid nitrogen as the refrigerant spouted from the lower refrigerant-spout pipe 170 and the upper refrigerant-spout pipe 180 turns into a mist, the liquid nitrogen immediately vaporizes in the depression part 14 and the depression part 25, and drastically increases in volume. Thereby, the depression part 14 and the depression part 25 increase in pressure. Consequently, the cooling water fed to the space between the lower die 110 and the workpiece W flows to move away from the depression part 14, and the cooling water fed to the space between the upper die 120 and the workpiece W flows to move away from the depression part 25 (see the black-painted arrows in FIG. 5).

As mentioned above, the gaseous refrigerant filling the depression part 14 and the depression part 25 acts as a pump for causing the cooling water to flow. This makes it possible to cause the cooling water to suitably spread over the forming surfaces of the lower die 110 and the upper die 120.

Moreover, the refrigerant cools the surrounding cooling water and the like, thus enabling to quickly cool the workpiece W.

In the present embodiment, the lower refrigerant-spout pipe 170 is provided to the depression part 14, and the upper refrigerant-spout pipe 180 is provided to the depression part 25. However, a configuration of the hot-pressing apparatus 100 is not limited thereto as long as the cooling water suitably flows. In other words, a lower refrigerant-spout pipe may be provided to at least one of the depression parts 14 and 15, and an upper refrigerant-spout pipe may be provided to at least one of the depression parts 24 and 25.

In the present embodiment, the lower refrigerant-spout pipe 170 is adopted as the refrigerant-feed means which feeds the refrigerant to the depression part 14, and the upper refrigerant-spout pipe 180 is adopted as the refrigerant-feed means which feeds the refrigerant to the depression part 25. However, another refrigerant-feed means may be adopted.

In the present embodiment, the lower die 110 and the upper die 120 are not provided with the vent passages 18 and 19, and the vent passages 28 and 29, respectively. However, the lower die 110 and the upper die 120 may be provided with the vent passages 18 and 19, and the vent passages 28 and 29, respectively. Moreover, the lower suction device 40 and the upper suction device 60 may be connected to the vent passages 18 and 19, and the vent passages 28 and 29, respectively.

In each embodiment as mentioned above, the lower die is provided with the depression parts 14 and 15, and the upper die is provided with the depression parts 24 and 25. However, the configurations of the lower and upper dies are not limited thereto, and a depression part may be provided to at least one of the lower and upper dies. In the case where the depression part is provided to only one of the lower and upper dies, the cooling water may not be fed to the space between the workpiece W and the other die (die provided with no depression part).

In each embodiment as mentioned above, the dies consist of the lower die having a protrusion, and the upper die having a recess. However, the dies may consist of the lower die having a recess, and the upper die having a protrusion.

In each embodiment as mentioned above, the dies have shapes to form the workpiece W into the hat shape, but the shapes thereof are not limited thereto. The present invention may be applied to a hot-pressing apparatus including lower and upper dies with other shapes.

INDUSTRIAL APPLICABILITY

The present invention is applied to a hot-pressing apparatus which presses and cools a heated workpiece at the same time.

REFERENCE SIGNS LIST

1: hot-pressing apparatus
10: lower die
11: protrusion
12, 13: external corner (working part)
14, 15: depression part
16: groove
17: water-feed channel (cooling water-feed means)
18, 19: vent passage
20: upper die
21: recess
22, 23: external corner (working part)
24, 25: depression part
26: groove
27: water-feed channel (cooling water-feed means)
28, 29: vent passage
30: lower water-feed device (cooling water-feed means)
40: lower suction device (suction device)
50: upper water-feed device (cooling water-feed means)
60: upper suction device (suction device)
100: hot-pressing apparatus
110: lower die
120: upper die
170: lower refrigerant-spout pipe (refrigerant-feed means)
180: upper refrigerant-spout pipe (refrigerant-feed means)

The invention claimed is:

1. A hot-pressing apparatus comprising a lower die having a lower forming surface, and an upper die having an upper forming surface facing the lower forming surface, which causes the lower die and the upper die to press a heated workpiece arranged therebetween, and at the same time, to keep the forming surfaces thereof in contact with a surface of the workpiece to cool the workpiece, the improvement comprising:

a depression part recessed inward from each of the lower forming surface of the lower die and the upper forming surface of the upper die such that the depression part does not directly contact the workpiece while the workpiece is being pressed, the depression part in the lower die is formed at a part of the lower die which faces an external corner of the upper die acting as a working part for bending the workpiece, and the depression part in the upper die is formed at a part of the upper die which faces an external corner of the lower die acting as the working part;

a water-feed channel through which cooling water for cooling the workpiece flows, and which is formed inside the lower die and the upper die from the forming surface to a surface thereof other than the forming surface; and a water-feed device that feeds the cooling water, through the water-feed channel, to a space between the workpiece and the lower die and the upper die where the depression part is formed.

2. The hot-pressing apparatus according to claim 1, wherein the lower die and the upper die where the depression part is formed has a vent passage through which steam generated when the cooling water comes in contact with the workpiece flows, and the vent passage is formed inside the lower die and the upper die from a surface thereof, other than the forming surface, to the space between the workpiece and the lower die and the upper die.

3. The hot-pressing apparatus according to claim 2, wherein the vent passage is formed from a surface of the lower die and the upper die, other than the forming surface, to the depression part.

4. The hot-pressing apparatus according to claim 3, further comprising:

a suction device which sucks the steam flowing through the vent passage, wherein the suction device is connected to the vent passage.

5. The hot-pressing apparatus according to claim 3, further comprising:

a refrigerant-feed means which feeds a refrigerant to the depression part, wherein the refrigerant-feed means is arranged in the depression part.

6. The hot-pressing apparatus according to claim 2, further comprising:

a suction device which sucks the steam flowing through the vent passage, wherein the suction device is connected to the vent passage.

7. The hot-pressing apparatus according to claim 6, further comprising:

a refrigerant-feed means which feeds a refrigerant to the depression part, wherein the refrigerant-feed means is arranged in the depression part.

8. The hot-pressing apparatus according to claim 2, further comprising:

a refrigerant-feed means which feeds a refrigerant to the depression part, wherein the refrigerant-feed means is arranged in the depression part.

9. The hot-pressing apparatus according to claim 1, further comprising:

a refrigerant-feed means which feeds a refrigerant to the depression part, wherein the refrigerant-feed means is arranged in the depression part.

* * * * *

UNITED STATES PATENT AND TRADEMARK OFFICE

CERTIFICATE OF CORRECTION

PATENT NO. : 9,227,238 B2
APPLICATION NO. : 14/126533
DATED : January 5, 2016
INVENTOR(S) : Shinji Ishii It is certified that error appears in the above-identified patent and that said Letters Patent is hereby corrected as shown below:

In the claims, starting at column 13, line 9 through column 14, line 22 please delete:

"4. The hot-pressing apparatus according to claim 3, further comprising:
a suction device which sucks the steam flowing through the vent passage,
wherein the suction device is connected to the vent passage.
5. The hot-pressing apparatus according to claim 3, further comprising:
a refrigerant-feed means which feeds a refrigerant to the depression part,
wherein the refrigerant-feed means is arranged in the depression part.
6. The hot-pressing apparatus according to claim 2, further comprising:
a suction device which sucks the steam flowing through the vent passage,
wherein the suction device is connected to the vent passage.
7. The hot-pressing apparatus according to claim 6, further comprising:
a refrigerant-feed means which feeds a refrigerant to the depression part,
wherein the refrigerant-feed means is arranged in the depression part.
8. The hot-pressing apparatus according to claim 2, further comprising:
a refrigerant-feed means which feeds a refrigerant to the depression part,
wherein the refrigerant-feed means is arranged in the depression part.
9. The hot-pressing apparatus according to claim 1, further comprising:
a refrigerant-feed means which feeds a refrigerant to the depression part,
wherein the refrigerant-feed means is arranged in the depression part."

And insert:

-- 4. The hot-pressing apparatus according to claim 2, further comprising:
a suction device which sucks the steam flowing through the vent passage,
wherein the suction device is connected to the vent passage.

Signed and Sealed this
Fifth Day of July, 2016

Michelle K. Lee

Michelle K. Lee
*Director of the United States Patent and Trademark Office*

5. The hot-pressing apparatus according to claim 1, further comprising:
    a refrigerant-feed means which feeds a refrigerant to the depression part, wherein the refrigerant-feed means is arranged in the depression part.
6. The hot-pressing apparatus according to claim 3, further comprising:
    a suction device which sucks the steam flowing through the vent passage, wherein the suction device is connected to the vent passage.
7. The hot-pressing apparatus according to claim 2, further comprising:
    a refrigerant-feed means which feeds a refrigerant to the depression part, wherein the refrigerant-feed means is arranged in the depression part.
8. The hot-pressing apparatus according to claim 3, further comprising:
    a refrigerant-feed means which feeds a refrigerant to the depression part, wherein the refrigerant-feed means is arranged in the depression part.
9. The hot-pressing apparatus according to claim 4, further comprising:
    a refrigerant-feed means which feeds a refrigerant to the depression part, wherein the refrigerant-feed means is arranged in the depression part. --